US005880653A

United States Patent [19]

Yamada et al.

[11] Patent Number: 5,880,653

[45] Date of Patent: Mar. 9, 1999

[54] ELECTROMAGNETIC RELAY AND ITS MANUFACTURE

[75] Inventors: Kazuo Yamada; Ryutaro Tsuchiya; Senjiro Ishibashi; Hitoshi Nakano; Mitsuhiro Kawai; Kiyoaki Kuzukawa; Kiyoshi Oka; Hiroyuki Miyaura; Yoshikaga Taguchi; Masayoshi Tani, all of Kyoto, Japan

[73] Assignee: Omron Corporation, Kyoto, Japan

[21] Appl. No.: 615,313

[22] PCT Filed: Sep. 14, 1994

[86] PCT No.: PCT/JP94/01521

§ 371 Date: Jun. 10, 1996

§ 102(e) Date: Jun. 10, 1996

[87] PCT Pub. No.: WO95/08180

PCT Pub. Date: Mar. 23, 1995

[30] Foreign Application Priority Data

Sep. 17, 1993 [JP] Japan ..... 5-231344
Oct. 13, 1993 [JP] Japan ..... 5-255622

[51] Int. Cl.[6] ..... H01H 51/22

[52] U.S. Cl. ..... 335/78; 335/128

[58] Field of Search ..... 335/78–86, 124, 335/128

[56] References Cited

U.S. PATENT DOCUMENTS 4,703,293 10/1987 Ono et al. ..... 335/80
5,153,543 10/1992 Hitachi et al. ..... 335/80
5,184,102 2/1993 Mueller ..... 335/128
5,673,011 9/1997 Okihara et al. ..... 335/128

FOREIGN PATENT DOCUMENTS 55-93624 7/1980 Japan .
58-65736 5/1983 Japan .
58-169838 10/1983 Japan .
61-70347 5/1986 Japan .
62-46935 10/1987 Japan .
1-7959 3/1989 Japan .
2-56333 4/1990 Japan .
3-163721 7/1991 Japan .
4-149924 5/1992 Japan .
4-192236 7/1992 Japan .
WO 88/10505 12/1988 WIPO .

*Primary Examiner*—Lincoln Donovan
*Attorney, Agent, or Firm*—Morrison & Foerster

[57] ABSTRACT

A manufacturing method for an electromagnetic relay whereby a base block 20 is monolithically molded to terminals 21–24 and connector tabs 62 provided in a lead frame 60. After separating the terminals 21–24 from the lead frame 60 and bending the terminals, a permanent magnet 30 and armature block 40 are assembled into the base block 20. A case 50 is then pressed down over the base block 20 to separate the base block 20 from the connector tabs 62 of the lead frame 60. Electrical inspection and aging treatment can thus be accomplished with the base block 20 connected to the lead frame 60, improving assembly precision and productivity.

5 Claims, 19 Drawing Sheets

ELECTROMAGNETIC RELAY AND ITS MANUFACTURE

FIELD OF THE INVENTION

The present invention relates to an electromagnetic relay and to its manufacture.

DESCRIPTION OF THE PRIOR ART

An electromagnetic relay according to the prior art typically comprises an electromagnet block 2 and armature 3 placed in sequence in a box-shaped base block 1 and then enclosed by fitting a case 4 to the base block 1 as shown in FIGS. 28–31.

More specifically, this is accomplished by first manufacturing from a hoop material by stamping and bending a lead frame 8 comprising on both long sides thereof coil terminals 6*a*, fixed contact terminals 6*b* comprising fixed contacts 7, and common terminals 6*c* as shown in FIG. 29. After positioning this lead frame 8 inside the cavity of a mold (not shown in the figures), said cavity is filled with a resin material to cast the base block 1. The coil terminals 6*a* and common terminals 6*c* are severed from the lead frame 8 (FIG. 30) and then bent, and the electromagnet block 2 and armature 3 are positioned in sequence inside the base block 1. The fixed contact terminals 6*b* are severed from the lead frame 8 and then bent, and the base block 1 is finally fit to the base block 1 to complete the manufacture and assembly of the electromagnetic relay.

The problem with this manufacturing method is related to the fixed contact terminals 6*b* functioning to connect the base block 1 to the lead frame 8. This prevents the fixed contact terminals 6*b* from being cut from the lead frame 8 during the assembly process, and electrical inspections cannot be conducted with the fixed contact terminals 6*b* connecting the base block 1 to the lead frame 8.

In addition, the aging treatment for eliminating the residual stress of the fixed contact terminals 6*b* resulting from the bending process cannot be accomplished with the base block 1 connected to the lead frame 8. A separate process is therefore required for aging the fixed contact terminals 6*b*, thus complicating the manufacturing process.

If in this manufacturing method the fixed contact terminals 6*b* are severed from the lead frame 8 after assembling the electromagnet block 2 and armature block 3 to the base block 1, deformation of the semifinished product to which the electromagnet block 2 and armature 3 are assembled may occur, reducing assembly precision. Because the fixed contacts 7 of the fixed contact terminals 6*b* are also hidden below the armature 3 when the severed fixed contact terminals 6*b* are bent, it is not possible to hold the fixed contacts 7 and it is therefore also difficult to position the fixed contacts 7 with high precision.

Low productivity also results with this manufacturing method because the case 4 cannot be fit to the base block 1 while the base block 1 remains connected to the lead frame 8, and assembly of the case 4 cannot follow continuously upon assembly of the electromagnet block 2 and armature 3.

Furthermore, after assembling the electromagnet block 2 and armature 3, and then fitting the case 4 to the box-shaped base block 1 as shown in FIG. 28, the electromagnetic relay described above must then be turned over as shown in FIG. 31 to seal the electromagnetic relay assembly by injecting a sealing agent 5 to the gap between the base block 1 and case 4 by means of an injection nozzle 9.

However, an electromagnetic relay according to the prior art as described above further comprises channels 1*a* and 1*b* formed continuously in a vertical direction in the exterior sides of the base block 1 as shown in FIG. 28. The terminals 6*a*, 6*b*, and 6*c* reside within these channels 1*a* and 1*b*. The presence of these channels 1*a* and 1*b* also results in a discontinuous contact face between the base block 1 and the case 4. It is therefore easy for the injected sealing agent 5 to flow through the channels 1*a* and 1*b* into the base block 1, and solidify therein. The solidified sealing agent 5 then interferes with the operation of the armature block 3, easily inducing inoperation of the electromagnetic relay. The amount of sealing agent 5 injected to the gap between the outside of the base block 1 and the inside face of the case 4 may also decrease, leading to insufficient and variable adhesion strength in the sealing agent 5.

It has therefore been proposed to use a high viscosity sealing agent as a means of reducing the free flow of the sealing agent and the problems resulting therefrom.

High viscosity sealing agents, however, have a poor flow characteristic, thus increasing the time required for the injection process and lowering productivity.

If the gap between the inside of the case 4 and the outside of the terminals 6*a*, 6*b*, and 6*c* after bending is reduced as a means of reducing the amount of sealing agent flowing along the terminals 6*a*, 6*b*, and 6*c* into the case 4, strict control of dimensional precision is required; this further increases the time and cost of design and manufacturing.

It is also necessary to inject the sealing agent 5 from directly above the gap formed between the base block 1 and case 4 because the bottom of the base block 1 and the lip around the case 4 are substantially flush when assembled. Positioning the injection nozzle 9 is therefore not easy, and productivity is poor.

The desired assembly precision and mechanical strength of the electromagnetic relay according to the prior art are also difficult to obtain because the electromagnet block 2 and armature 3 are separately assembled to the box-shaped base block 1. In addition, the desired insulation characteristics are also difficult to obtain between the electromagnet block 2 and the armature 3 because of the proximity therebetween.

A fairly large quantity of sealing agent 5 is also required because the bottom of the base block 1 and the lip around the case 4 are substantially flush when assembled, and the sealing agent 5 must be injected to this outside lip of the case 4.

If an electromagnetic relay of this type is mounted to a printed circuit board and the printed circuit board is then deformed by repeated expansion and contraction, this deformation cannot be absorbed by the elastic deformation of the terminals 6*a*, 6*b*, and 6*c* because of the shortness of the length $L_2$ of the terminals 6*a*, 6*b*, and 6*c* projecting from the lip of the case 4 (see FIG. 31), and the electromagnetic relay may separate from the printed circuit board.

SUMMARY OF THE INVENTION

Therefore, an object of the present invention is to provide a high assembly precision, high productivity manufacturing method for an electromagnetic relay resolving the problems associated with the manufacturing method of an electromagnetic relay according to the prior art by enabling electrical inspection and aging treatment to be accomplished while the base block remains connected to the lead frame.

To achieve this object, a manufacturing method for an electromagnetic relay according to a first embodiment of the present invention comprises: a process for forming a lead frame comprising a plurality of terminals and at least one set of connector tabs by stamping a hoop material; a process for monolithically molding the base block to the terminals and connector tabs of this lead frame; a process for assembling the internal component parts to the base block after severing the terminals from the lead frame and then bending the terminals; and a process for then causing the end of the connector tabs of the lead frame to be extracted from the outside surface of the base block to separate the lead frame from the base block.

A manufacturing method for an electromagnetic relay according to a second embodiment of the present invention comprises: a process for forming a lead frame comprising a plurality of terminals and at least one set of connector tabs by stamping a hoop material; a process for positioning and then connecting an electromagnet block to a specified terminal of the lead frame; a process for postforming the electromagnet block and monolithically molding the base block to the terminals and connector tabs; a process for assembling the internal component parts to the base block after severing the terminals from the lead frame and then bending the terminals; and a process for then causing the end of the connector tabs of the lead frame to be extracted from the outside surface of the base block to separate the lead frame from the base block.

The third and fourth embodiments of a manufacturing method according to the invention are characterized by the process separating the base block from the lead frame in the first and second embodiments above, respectively, severing the connector tabs of the lead frame as the means of separating the base block from the lead frame.

Because the connector tabs are formed separately to the terminals on the lead frame, and the resulting subassembly is then monolithically molded to the base block by means of a manufacturing method for an electromagnetic relay having any one of the first through fourth characteristics described above, the base block remains integrally connected to the lead frame by means of the connector tabs even after all of the terminals are severed from the lead frame and bent. As a result, if the internal component parts are assembled into the base block, electrical inspection is possible with the base block supported by the lead frame.

Furthermore, because the base block remains connected to the lead frame even after the terminals are severed and bent, aging treatment of the terminals is possible with the base block supported by the lead frame.

In addition, because the internal component parts are installed after severing and bending all terminals, it is not only possible to hold the fixed contacts provided on the fixed contact terminals with a tool for bending the fixed contact terminals, deformation of the semifinished product as occurs in conventional methods from cutting the terminals can be prevented. As a result, the positioning precision of the fixed contacts and the dimensional accuracy of the semifinished product are improved.

Also, because the base block remains connected to the lead frame by means of the connector tabs even after the terminals are severed from the lead frame and bent, the case and other components can be assembled continuously to the base block while the base block remains integrally connected to the lead frame. A further benefit of the invention, therefore, is improved productivity in electromagnetic relay manufacture.

A manufacturing method for an electromagnetic relay according to a fifth embodiment of the present invention further comprises a process for placing inside the cavity of the mold a spool wrapped with a coil; and directly injecting resin from the gate of the mold directly into at least one of the positioning holes provided in said spool to fill said cavity with the resin material.

By means of this fifth embodiment of the invention, the spool is accurately positioned in the cavity of the mold by the resin pressure of the resin injected from the gate of the mold. Positioning pins and clamps for positioning and holding the spool are therefore not necessary, and reduced dimensional accuracy induced by the thermal expansion of these can be eliminated.

In particular, because the spool is pressed against the base surface of the mold and thus positioned by the resin pressure of the molten resin material, not only is the need for clamps eliminated, but more flexible positioning is made possible, positioning to the best part is possible, and dimensional accuracy is improved.

Furthermore, because pins and clamps are not necessary, the internal structure of the mold is simplified, and mold production is therefore also simplified.

In addition, because the spool is pressed against the base surface of the mold and thus positioned by the resin pressure of the molten resin material, deformation of the spool and/or other components caused by compressing the mold does not occur even if there is some variation in the dimensional accuracy of the spool and/or other components. In addition, the spool and/or other components will not become loose inside the cavity, and dimensional accuracy is improved further.

Because the resin material is also flowed into the cavity from the mold gate through a positioning hole, the gate part of the electromagnetic apparatus continuous to the mold gate is formed from extremely thick resin. As a result, it is not necessary to separately provide a thick resin part to prevent damage from demolding, and the shape of the electromagnet apparatus is simplified.

Furthermore, because the postforming resin material flows into and fills the positioning hole of the spool, etc., it is not necessary to fill the positioning hole in a later process, and productivity is thus improved.

A further object of the invention is to provide an electromagnetic relay resolving the problems associated with an electromagnetic relay according to the prior art as described above, and is characterized by enabling the simple and quick accomplishment of the sealing operation; assuring a consistent, positive seal using a small amount of sealing agent; obtaining excellent electrical insulation properties and the desired assembly precision and mechanical strength; and good resistance to separation of the terminals thereof from a printed circuit board on which the electromagnetic relay is mounted.

To achieve the aforementioned object, an electromagnetic relay according to a sixth embodiment of the invention is constructed with the terminals projecting from the top perimeter area of the outside surface of the box-shaped base block housing the electromagnet block bent downward from the terminal base; a sealing agent injected to and cured in to seal the space formed between the box-shaped base block and the box-shaped case fit to the box-shaped base block; and is characterized by a continuous fitting surface being provided at the top perimeter area of the outside surface of the box-shaped base block.

By means of the configuration of this sixth embodiment, the fitting surfaces continuous to the outside surface of the base block contact the inside surface of the case, thereby preventing the sealing agent from penetrating inside the base block. Operating problems caused by resin solidifying inside the base block are thus prevented, and yield is improved.

Furthermore, because the fitting surfaces are continuous to the outside surface of the base block, there is no variation in the adhesion strength, and a consistent seal can be obtained.

Moreover, because penetration of the sealing agent can be prevented by the fitting surfaces, the high dimensional accuracy required by the prior art in the gap between the outside surface of the bent terminals and the inside surface of the case is not required, and design and manufacture are simplified.

In addition, because the electromagnetic relay can be sealed by simply injecting and curing a sealing agent around the perimeter of the fitting surfaces, it is not necessary as it is in the prior art to fill the entire area where the base block and case are fit together with the sealing agent, and it is possible to reduce the amount of sealing agent required.

An electromagnetic relay according to a seventh embodiment of the invention is based on the sixth embodiment wherein the electromagnet block is postformed and integrally molded to the box-shaped base block.

The electrical insulation of the armature block is improved by means of this seventh embodiment because the electromagnet block is coated with a resin material and monolithically molded to the base block; and because the electromagnet block and base block are molded without gap therebetween into a monolithic body, the assembly precision is improved and mechanical strength is increased.

An electromagnetic relay according to an eighth embodiment of the invention is further characterized by the bottom part of the box-shaped base block projecting from the open side of the box-shaped case.

By means of this configuration, the side edge members near the bottom surface of the base block are exposed, making it possible to inject the sealing agent from a variable side position. The degree of freedom in sealing process operations is thereby increased, and production is thus facilitated.

Elastic deformation of the terminals is also improved because the length of the free end part of the terminals projecting from the opening in the case is longer than in the prior art. As a result, when an electromagnetic relay according to the present invention is surface mounted to a printed circuit board, repeated expansion and contraction of the circuit board due to heat can be absorbed by the elastic deformation of the terminals, thereby inhibiting separation of the terminals of the electromagnetic relay from the printed circuit board.

An electromagnetic relay according to a ninth embodiment of the invention is based on the eighth embodiment wherein an inclined face for guiding the sealing agent is provided in the side edge members near the bottom surface of the base block.

By means of this configuration, the inclined face for guiding the sealing agent provided in the side edge members near the bottom surface of the base block forms a positioning surface for use during sealing agent injection.

Positioning of the nozzle used for sealing agent injection is thereby made even easier, and productivity is thus improved.

An electromagnetic relay according to a tenth embodiment of the invention is further characterized by the middle part of the terminals projecting from the box-shaped base block being bent to the outside and fit into the notched member formed in the lip of the opening in the box-shaped case, and the outside surface of the case being formed flush with the outside surface of the middle parts of the terminals.

By means of this configuration, the outside surface of the middle parts of the terminals and the outside surface of the case are flush, and a gap is formed between the inside surface of the middle parts of the terminals and the outside surface of the base block, thus making positioning easier during sealing agent injection, and thereby further improving productivity.

According to the eleventh embodiment of the invention, an electromagnetic relay wherein the fixed contact terminals and coil terminals integrally formed to a roughly rectangular lead frame by stamping a single conductive sheet material are insertion molded to the base is characterized by the fixed contact terminals being formed in roughly an inverted "L" shape from one side of the lead frame toward roughly the center area of the adjoining edge; the coil terminals being formed in a U-shape through a connecting member from the center of said adjoining edge; and said connecting member being bent in the thickness direction, providing a step between the coil terminals and the fixed contact terminals.

By means of this eleventh embodiment, the coil terminals can move in the thickness direction without moving the free ends of the coil terminals to the outside because the connecting member of the coil terminals extending in a U-shape is bent in the thickness direction. A large step can thus be formed between the coil terminals and the fixed contact terminals, and the desired insulation distance can be assured.

According to the twelfth embodiment of the invention, an electromagnetic relay wherein the fixed contact terminals and coil terminals integrally formed to a roughly rectangular lead frame by stamping a single conductive sheet material are insertion molded to the base is characterized by the fixed contact terminals being formed in an inverted "L" shape from one side of the lead frame toward roughly the center area of the adjoining edge; the coil terminals being formed in a mirrored L-shape through a connecting member to the outside from the base of the fixed contact terminals; and said connecting member being bent in the thickness direction, providing a step between the coil terminals and the fixed contact terminals.

By means of this twelfth embodiment, the coil terminals can move in the thickness direction without moving the free ends of the coil terminals to the outside because the connecting member of the coil terminals extending in a mirrored L-shape is bent in the thickness direction. A large step can thus be formed between the coil terminals and the fixed contact terminals, and the desired insulation distance can be assured.

BRIEF DESCRIPTION OF THE DRAWINGS

The present invention will become more fully understood from the detailed description given below and the accompanying diagrams wherein.

DESCRIPTION OF PREFERRED EMBODIMENTS

Figure 1:
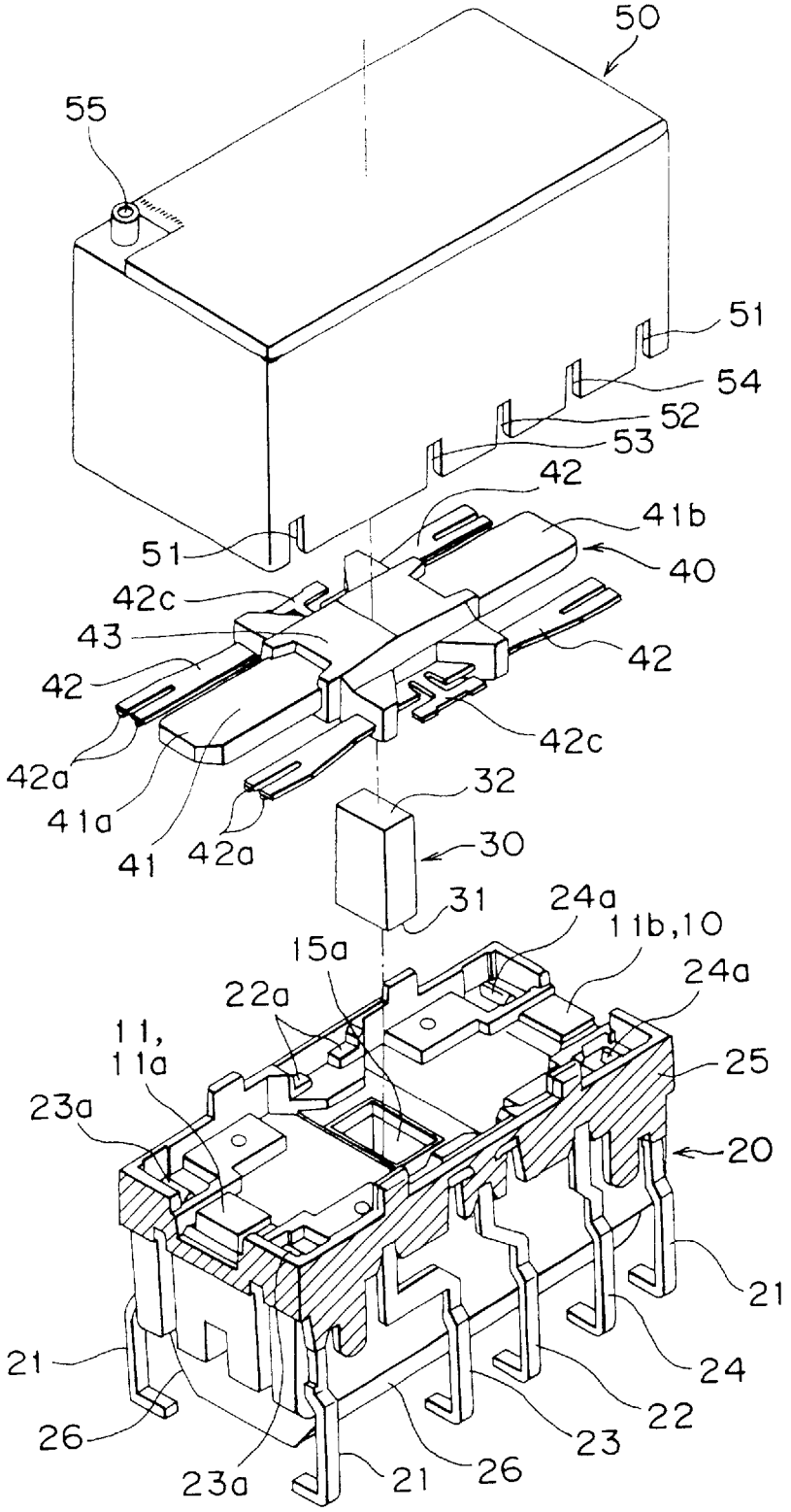
FIG. 1 is a bird's-eye exploded view of an electromagnetic relay according to the preferred embodiment of the present invention.
Figure 2:
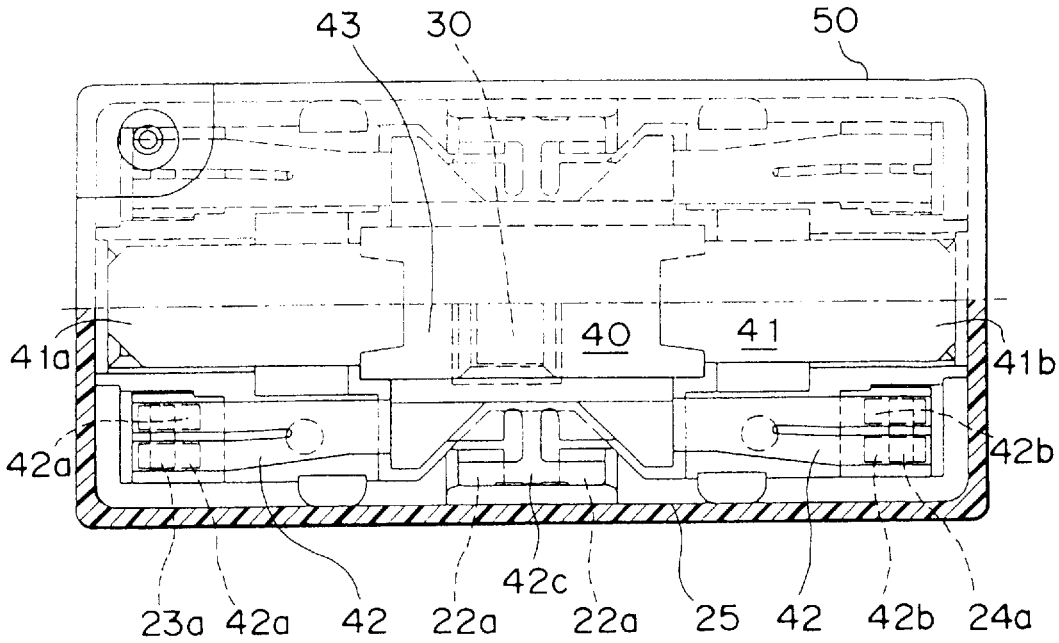
FIG. 2 is a partial cross section of a plan view of the electromagnetic relay shown in FIG. 1.

The preferred embodiments of the present invention are described hereinbelow with reference to the accompanying FIGS. 1–27. As shown in FIGS. 1–25, the electromagnetic relays of the present invention comprise primarily an electromagnet block 10, a base block 20 formed by postforming the electromagnet block 10, a permanent magnet 30, an armature block 40, and a case 50.

Figure 5:
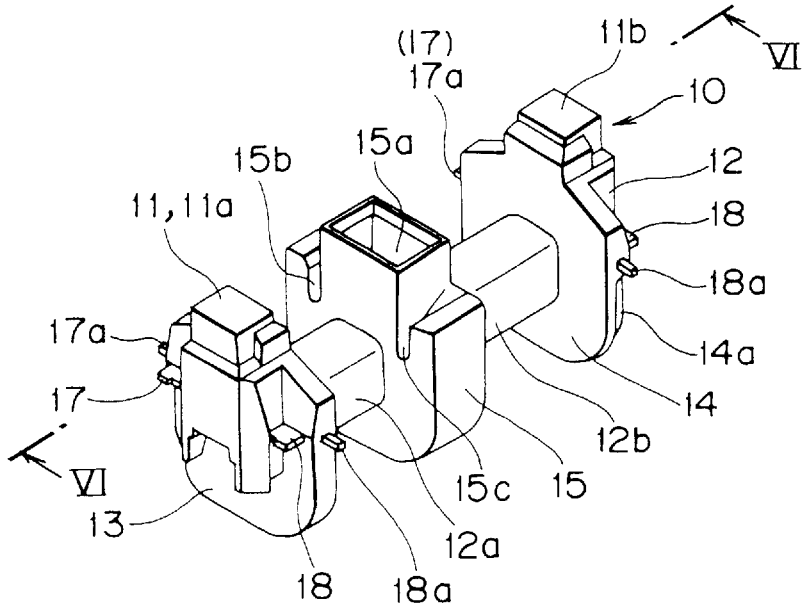
FIG. 5 is a bird's-eye view of the electromagnet block of an electromagnetic relay according to the present invention.
Figure 6:
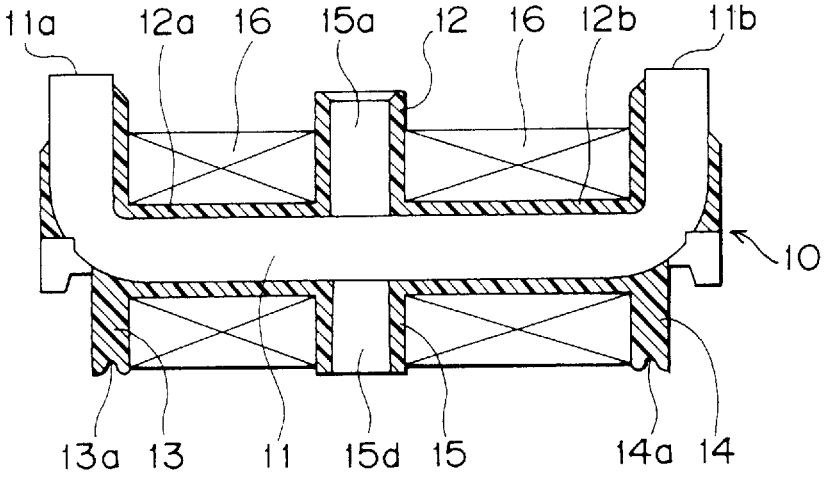
FIG. 6 is a cross section of the electromagnet block shown in FIG. 5 through line VI—VI therein.

As shown in FIGS. 5 and 6, the electromagnet block 10 is formed by winding a coil 16 around a spool 12 formed by insertion molding a C-shaped core 11. Note that for ease of illustration, the coil 16 is not shown in FIG. 5.

Figure 11:
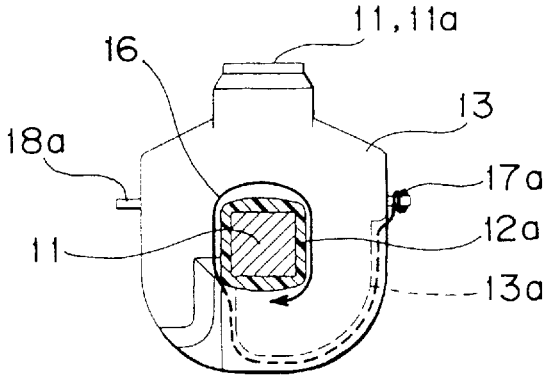
FIG. 11 is a cross section of the electromagnet block shown in FIG. 8 through line XI—XI therein.
Figure 12:
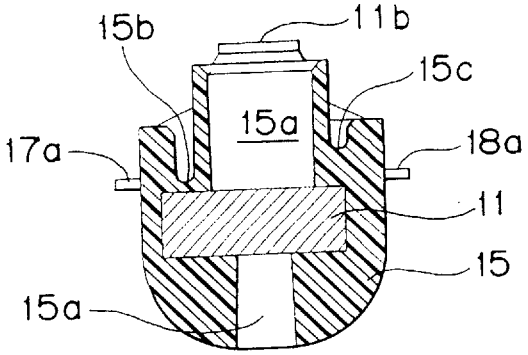
FIG. 12 is a cross section of the electromagnet block shown in FIG. 8 through line XII—XII therein.

As shown in FIG. 5, the core 11 is provided at both ends thereof with pole faces 11*a* and 11*b* which are exposed above the top surface of the collars 13 and 14 formed on the ends of the spool 12. One set of relay terminals 17 and 18 is insertion molded to each of the collars 13 and 14, and binding members 17*a* and 18*a* project from the sides of the collars 13 and 14. A guide channel 13*a* is also formed in the side edge of the collar 13; one end of this guide channel 13*a* is positioned near the base of the binding member 17*a* as shown in FIG. 11, and the other end is provided at the inside surface of the collar 13 near the outside surface of a first waist member 12*a*. Another guide channel 14*a* similar to this guide channel 13*a* is also formed in the other collar 14 (see FIG. 8).

Figure 7:
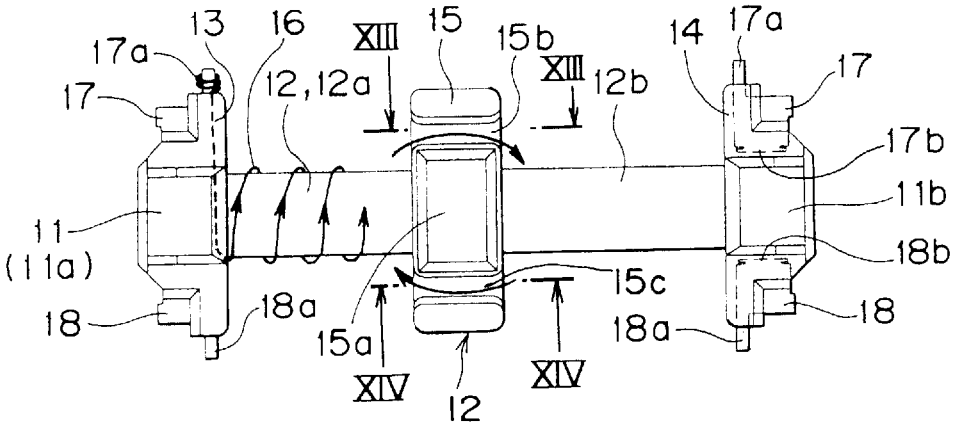
FIG. 7 is a plan view of the electromagnet block shown in FIG. 5.
Figure 8:
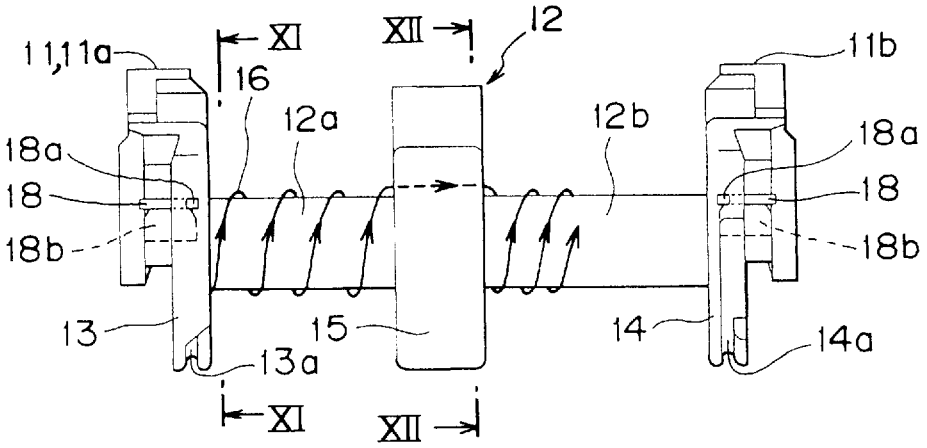
FIG. 8 is a front view of the electromagnet block shown in FIG. 5.
Figure 9:
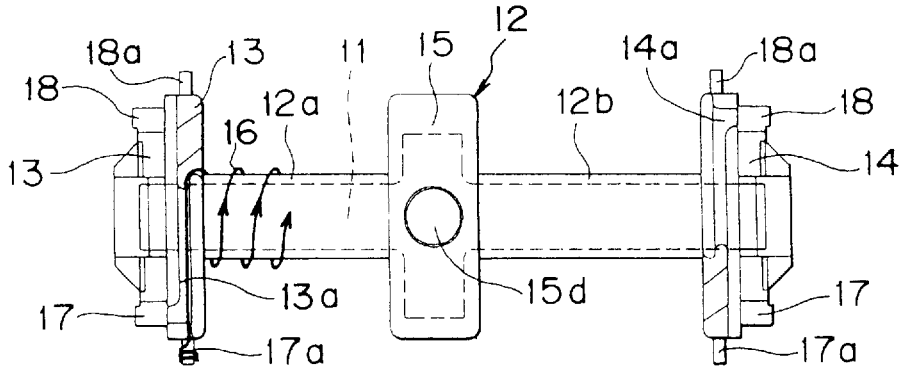
FIG. 9 is a bottom view of the electromagnet block shown in FIG. 5.
Figure 10:
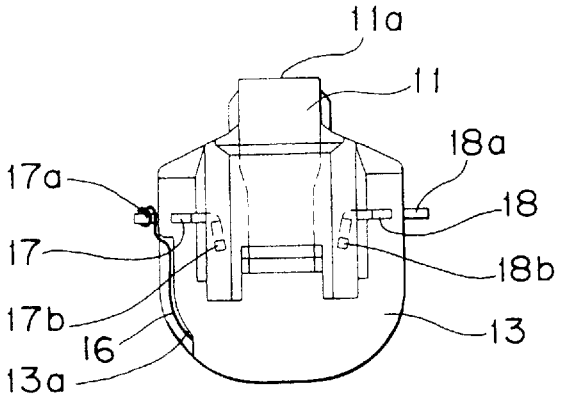
FIG. 10 is a left side view of the electromagnet block shown in FIG. 5.

As shown in FIGS. 7, 8, and 10, the relay terminals 17 and 18 each comprise an anchor member 17*b* and 18*b*, respectively, insertion molded deep in the respective collar 13 and 14 in a manner preventing extraction of the anchor member.

Figure 13:
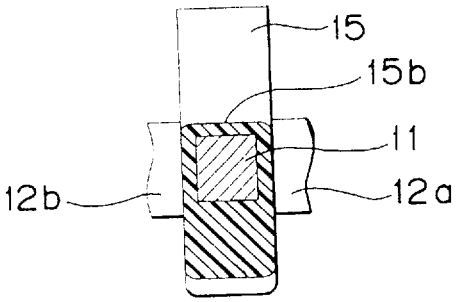
FIG. 13 is a cross section of the electromagnet block shown in FIG. 7 through line XIII—XIII therein.
Figure 14:
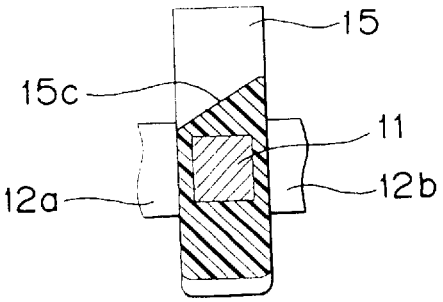
FIG. 14 is a cross section of the electromagnet block shown in FIG. 7 through line XIV—XIV therein.
Figure 15:
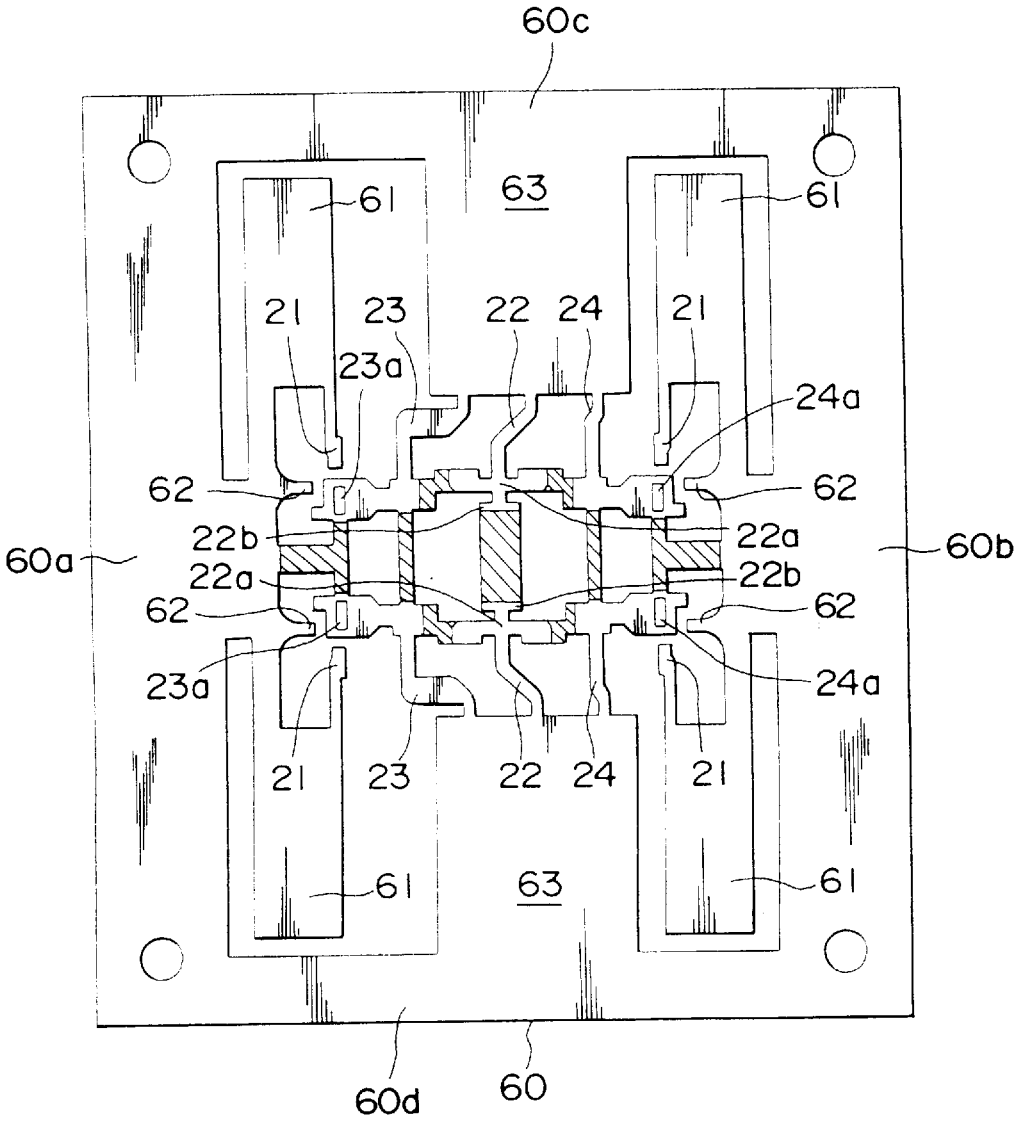
FIG. 15 is a plan view of the lead frame used in the manufacture of an electromagnetic relay according to the present invention.
Figure 16:
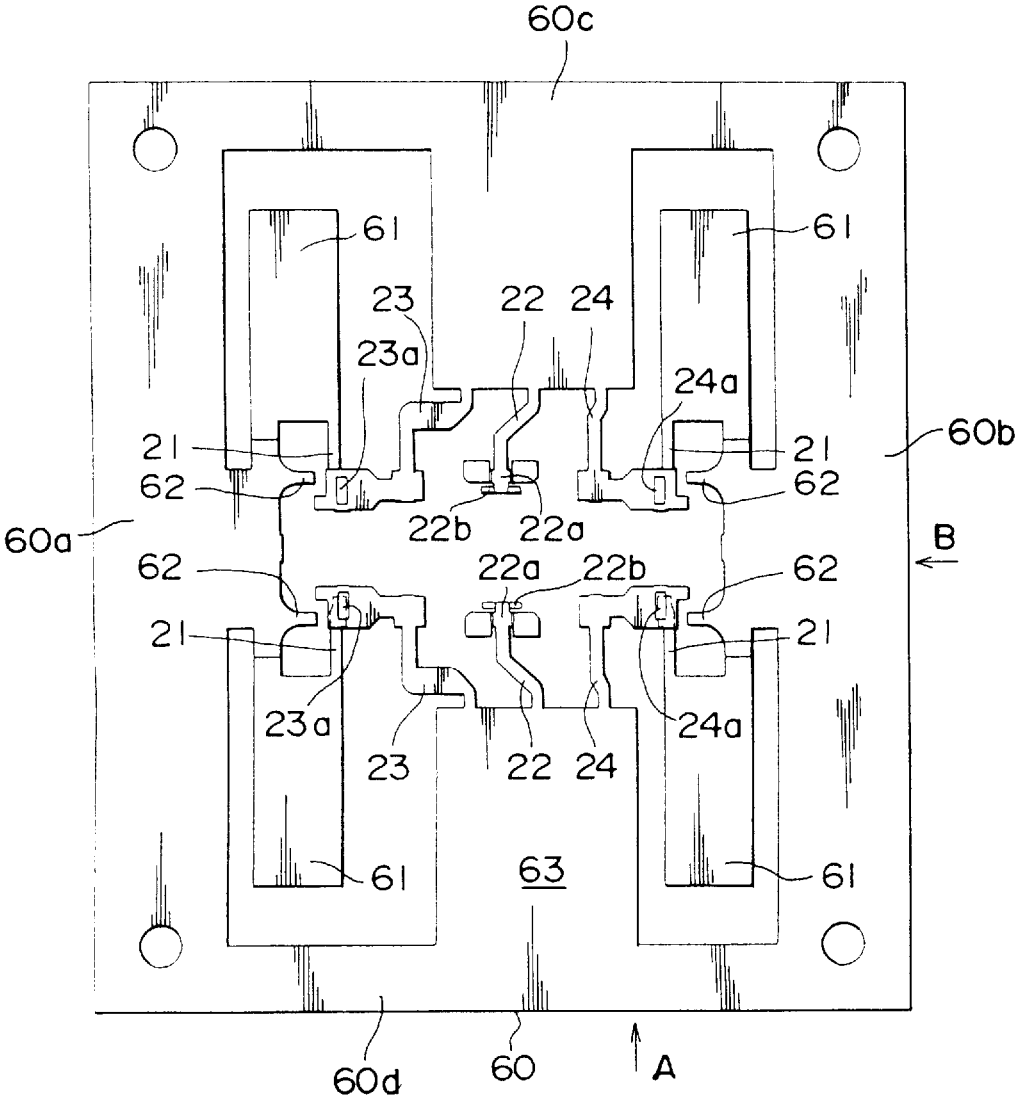
FIG. 16 is a plan view showing the lead frame in FIG. 15 after the bending process is accomplished.
Figure 17:
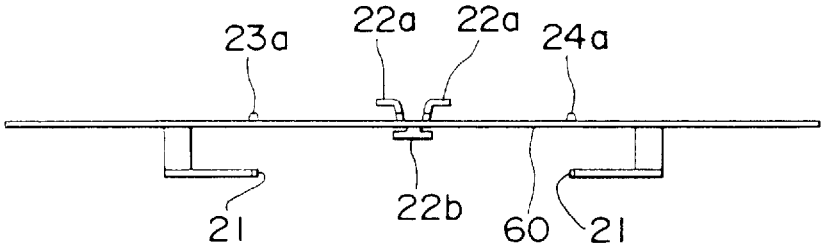
FIG. 17 is a front view of the lead frame shown in FIG. 16 in the direction of arrow A in FIG. 16.
Figure 18:
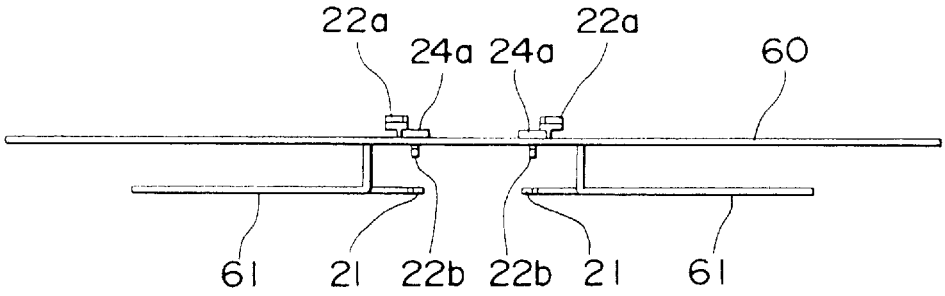
FIG. 18 is a right side view of the lead frame shown in FIG. 15 in the direction of arrow B in FIG. 15.

An insertion hole 15*a* for inserting the permanent magnet 30, described later below, is formed in the center collar 15 provided at a position offset from the lengthwise center of the spool 12, and parallel guide channels 15*b* and 15*c* are provided with the insertion hole 15*a* therebetween. The bottom of the guide channel 15*b* is flat as shown in FIG. 13 with both ends positioned near the outside surface of the first and second waist members 12*a* and 12*b*. The bottom of the other guide channel 15*c* is inclined as shown in FIG. 14 with one end positioned near the outside surface of the first waist member 12*a*, and the other end provided at a position elevated slightly above the outside surface of the second waist member 12*b*. The ends of the guide channels 15*b* and 15*c* on the side toward the first waist member 12*a* are provided substantially equidistant from the outside surface of the first waist member 12*a*. It is to be further noted that the shapes of the guide channels 15*b* and 15*c* shall not be limited to that described above, and the angle of inclination, specific positions, and other parameters may be designed appropriately according to the number of winds in the coil.

Therefore, as shown in FIGS. 7–11, after winding one end of the coil 16 to the binding member 17*a* of the relay terminal 17 insertion molded to the collar 13, the coil 16 is pulled along the guide channel 13*a* in the collar 13 to the first waist member 12*a* in the spool 12, and wound to approximately 20% of the desired number of winds. The coil 16 is then pulled through the guide channel 15*b* in the center collar 15 to the second waist member 12*b*, and wound to 100% of the desired number of winds. The coil 16 is then pulled back through the inclined guide channel 15*c* in the center collar 15 to the first waist member 12*a*, and wound the remaining 80% of the desired number of winds. After then winding the coil 16 to the binding member 18*a* of the other relay terminal 18, the coil 16 is soldered to both binding members 17*a* and 18*a* to complete the coil winding process.

By means of this embodiment, because the number of winds to the first waist member 12*a* accomplished in the first winding operation of the coil 16 is only about 20% of the total, and the remaining 80% is then wound during the second winding operation, the final end wind of the coil 16 is separated by a predetermined distance from the end of the first wind of the coil 16 to the first waist member 12*a*. As a result, even if the insulation coating of the coil 16 at the final outside surface of the coil is slightly melted and removed by the heat of the resin material during the postforming process described below, the voltage difference between the coil 16 at the outside surface and the coil 16 directly therebelow is small; resistance to shorting is thereby improved, and production yield is improved.

It is to be noted that while the coil is first wound to approximately 20% of the total winds to the first waist member 12*a*, is then wound to 100% of the winds to the second waist member 12*b*, and is then wound the remaining 80% to the first waist member 12*a*, the invention shall not be so limited. It is also possible, for example, to first wind the coil to approximately 50% of the total winds to the first waist member 12*a*.

The base block 20 is formed by integrating the electromagnet block 10 and the lead frame 60 in a postforming process. As shown in FIGS. 15–18, this lead frame 60 is formed by bonding fixed contacts 23*a* and 24*a* to a predetermined position in the hoop material; stamping to form on the inside of the roughly rectangular frame the coil terminals 21, common terminals 22, part of the fixed contact terminals 23 and 24, and the connector tabs 62; cutting away the shaded areas shown in FIG. 15; and then bending the coil terminals 21 in the thickness direction of the sheet (see FIGS. 16–18).

Note in particular that a pair of connector tabs 62 project from roughly the center of opposing sides 60*a* and 60*b* of the lead frame 60, and the coil terminals 21 form a basic U-shape from the base of the connector tabs 62 through the connecting member 61.

The lead frame 60 further comprises connecting members 63 at approximately the middle of the sides 60*c* and 60*d* adjoining the sides 60*a* and 60*b* on which the connector tabs 62 are provided. The common terminals 22 comprising a T-shaped connector receiver 22*a* on the free end thereof are provided from approximately the center of the connecting members 63.

The fixed contact terminals 23 and 24 extend from the connecting members 63 on opposite sides of the common terminals 22, and respectively comprise fixed contacts 23*a* and 24*a* roughly perpendicular to the fixed contact terminals 23 and 24 on the free ends thereof.

Figure 19:
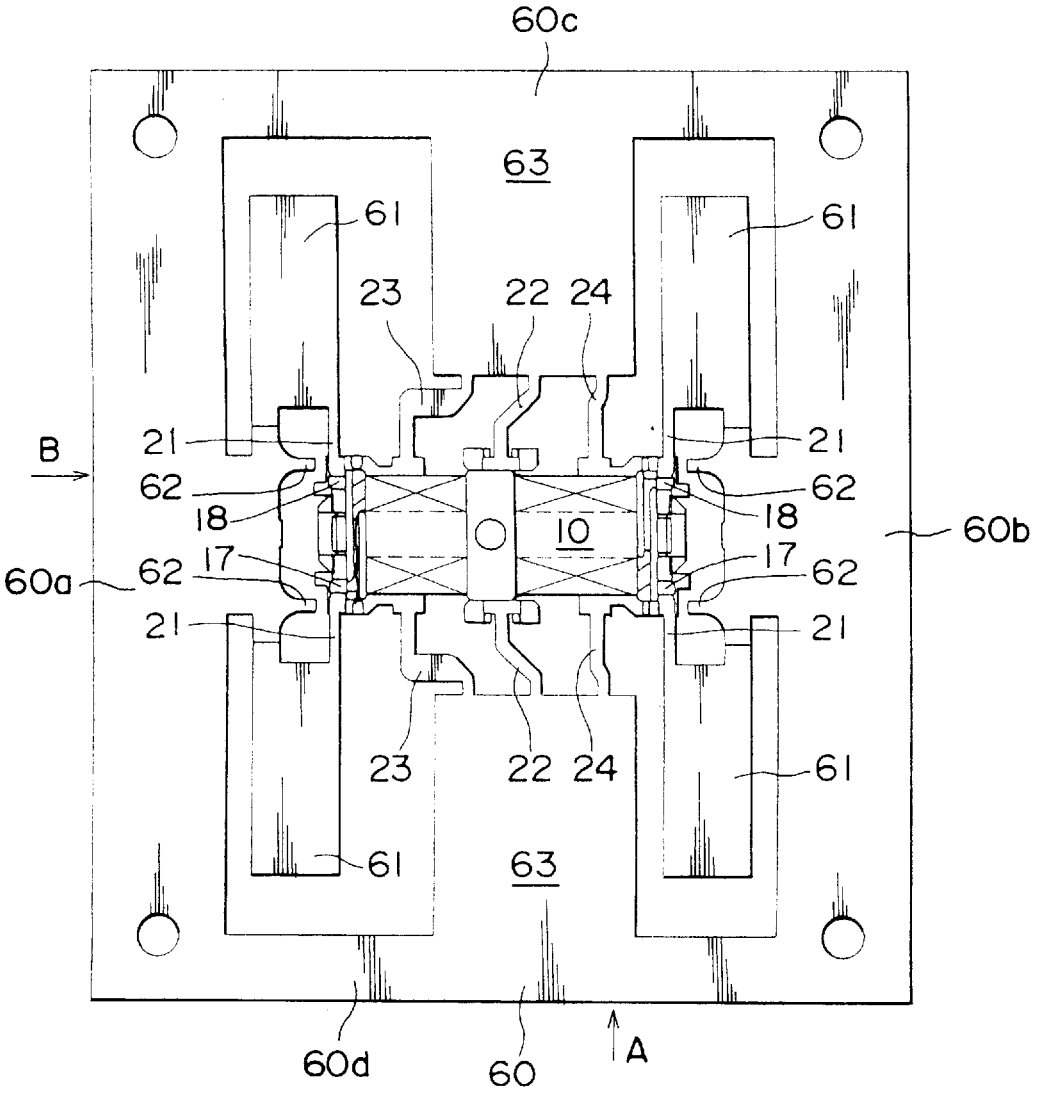
FIG. 19 is a plan view of the electromagnet block provided on the lead frame used in the manufacture of an electromagnetic relay according to the present invention.
Figure 20:
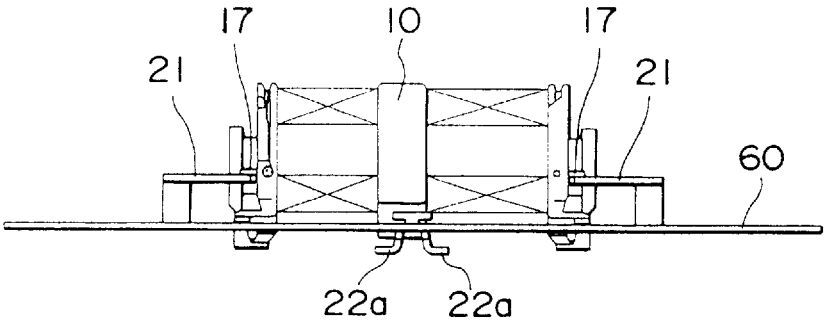
FIG. 20 is a front view of the lead frame shown in FIG. 19 in the direction of arrow A in FIG. 19.
Figure 21:
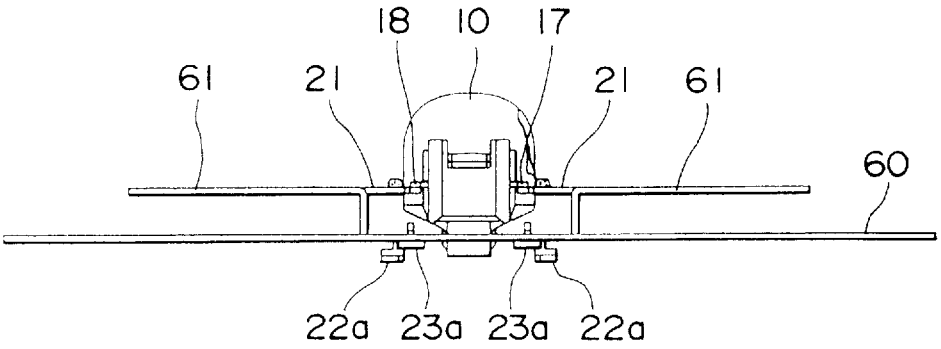
FIG. 21 is a left side view of the lead frame shown in FIG. 19 in the direction of arrow B in FIG. 19.

As shown in FIGS. 19–21, the lead frame 60 is then turned over, and the relay terminals 17 and 18 of the electromagnet block 10 are then positioned on the free ends of the coil terminals 21 and connected integrally thereto by laser welding.

Figure 22:
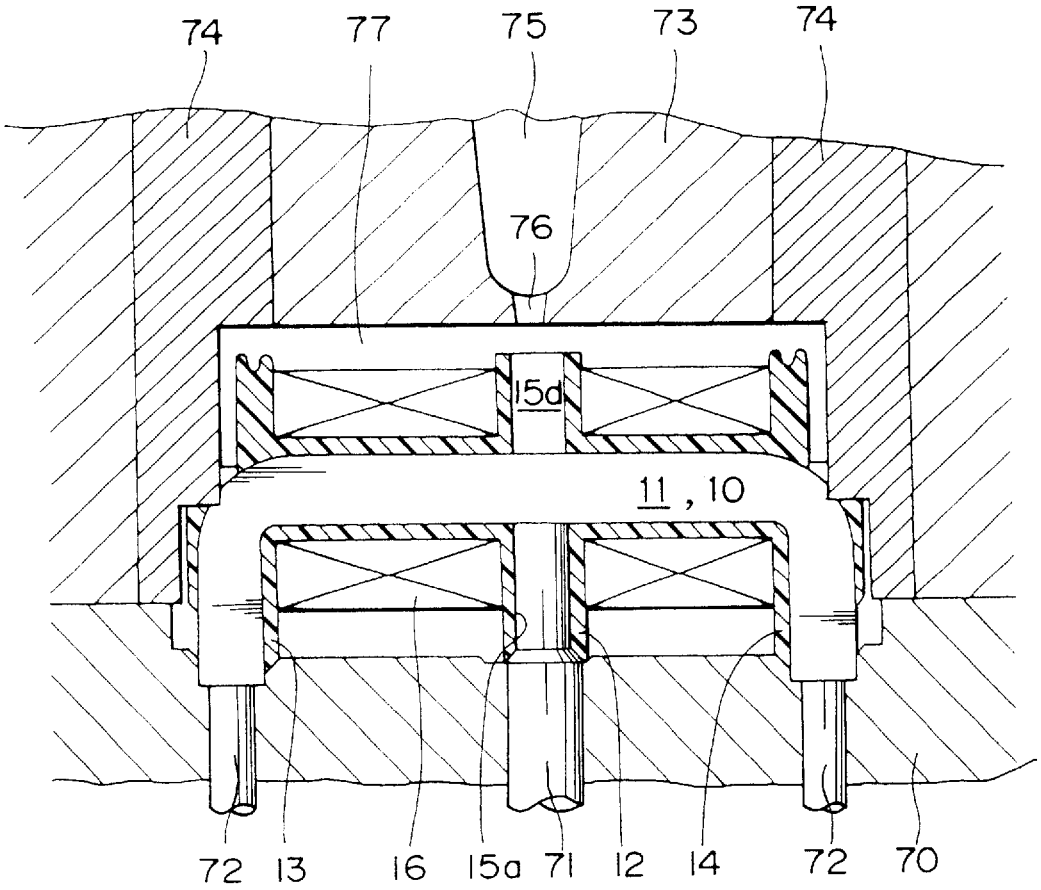
FIG. 22 is a cross section showing the postforming method used in the manufacture of an electromagnetic relay according to the present invention.

Next, as shown in FIG. 22, the integral assembly of the electromagnet block 10 and the lead frame 60 is assembled into the bottom mold 70. The top mold 73 is then fit to the bottom mold 70, and the corner of the core 11 is engaged by the positioning members 74 of the top mold 73, thereby fitting the insertion hole 15*a* in the electromagnet block 10 to the positioning pin 71 in the bottom mold 70 and pressing the pole faces 11*a* and 11*b* of the core 11 against the support pins 72 to complete the initial positioning.

The molten resin material is then injected from the gate 76 of the runner 75 provided in the top mold 73 to the injection hole 15*d* in the electromagnet block 10. The pressure of the injected resin pushes and strongly positions the electromagnet block 10 against the bottom mold 70, and the resin material overflow from the injection hole 15*d* fills the cavity 77 to form the base block 20. The bottom mold 70 is then lowered to demold the molded base block 20 from the top mold 73, and the support pins 72 are used to eject the core 11 and thus demold the completed base block 20 from the bottom mold 70 (see FIG. 24). Note that a continuous fitting surface 25 (the shaded area in FIG. 1) is formed around the top outside edge member of the base block 20, and an inclined face 26 for guiding the sealing agent is provided in the outside edge members near the bottom of the base block.

One benefit of the present embodiment thus comprised is the high dimensional accuracy obtained by providing the positioning pin 71 substantially coaxially to the gate 76, and preventing deformation of the core 11 in the thickness direction by the resin pressure. This deformation in the thickness direction can be effectively prevented even if, for example, the electromagnet block 10 comprises a U-shaped core 11 measuring approximately 2 mm wide, 2 mm thick, and 15 mm long, and high dimensional accuracy can thus be assured.

Figure 23:
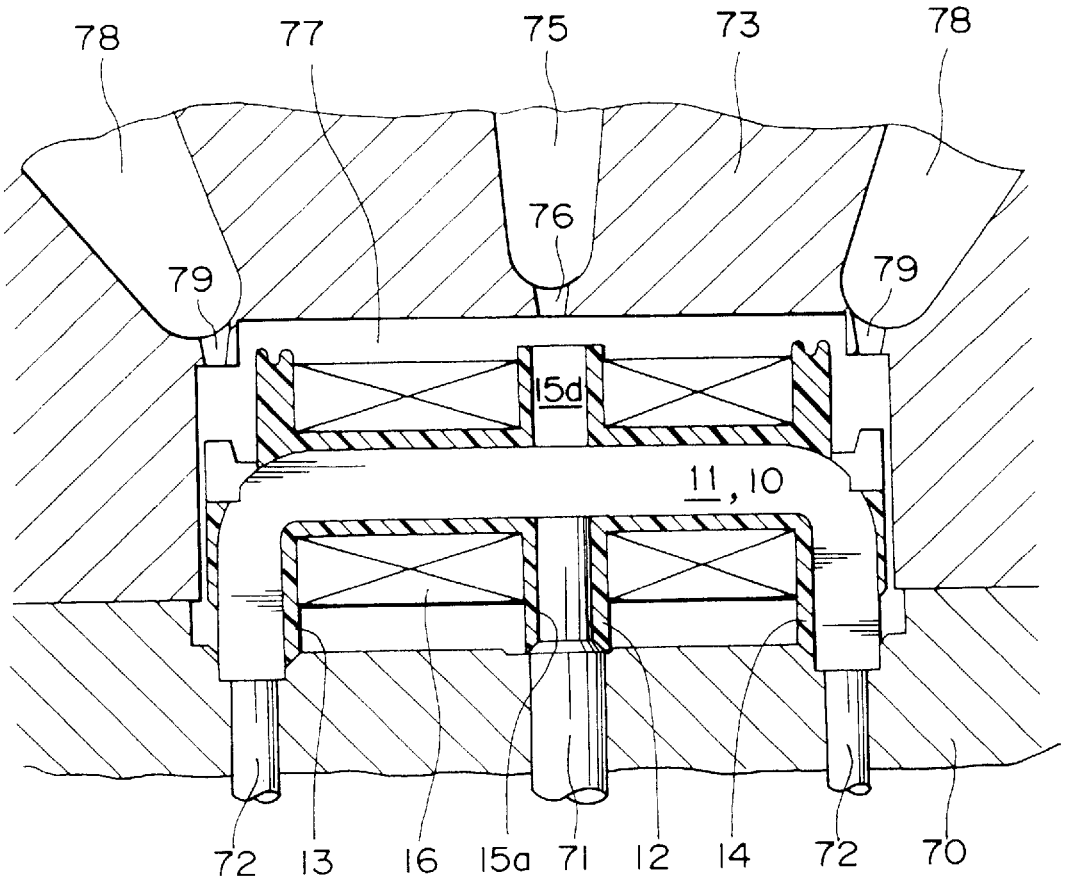
FIG. 23 is a cross section showing a postforming method different from the postforming method shown in FIG. 22.
Figure 24:
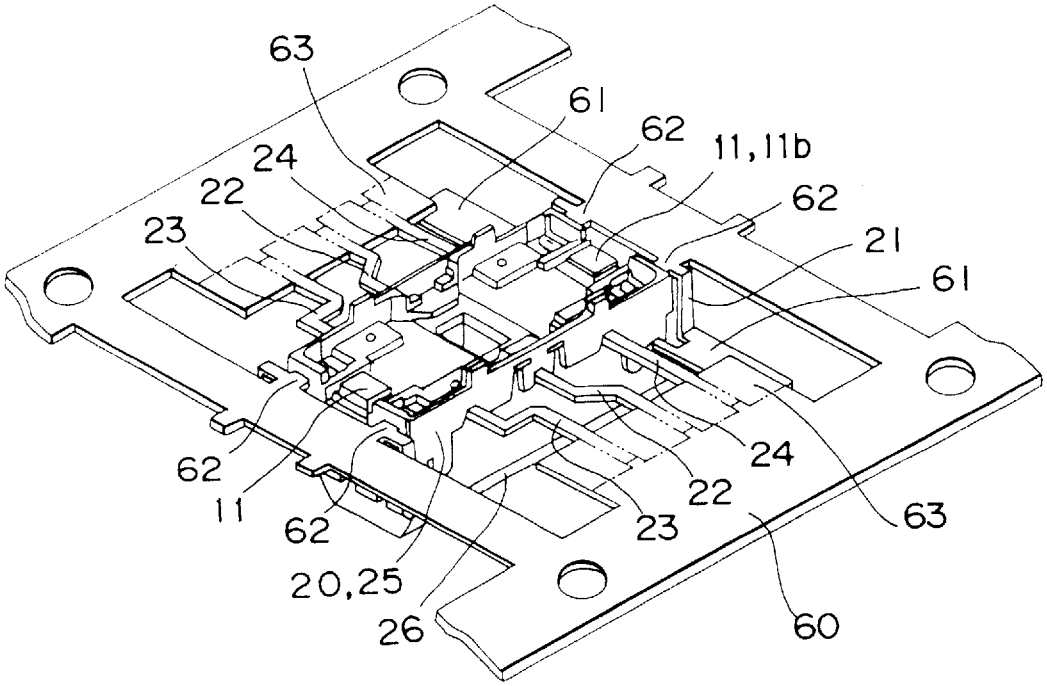
FIG. 24 is a bird's-eye view of the base block formed by a postforming method according to the present invention.

In the above embodiment the electromagnet block 10 is initially positioned to the bottom mold 70 by the positioning members 74 provided in the top mold 73, and is then firmly positioned by the resin pressure of the resin material injected from the runner gate 76, but the invention shall not be so limited. As shown in FIG. 23, for example, additional runners 78 with gates 79 may be provided in the top mold 73, and the resin material injected from each of the gates 76 and 79. In this case, too, the resin pressure of the injected resin material will press and firmly position the electromagnet block 10 against the bottom mold 70.

Figure 26:
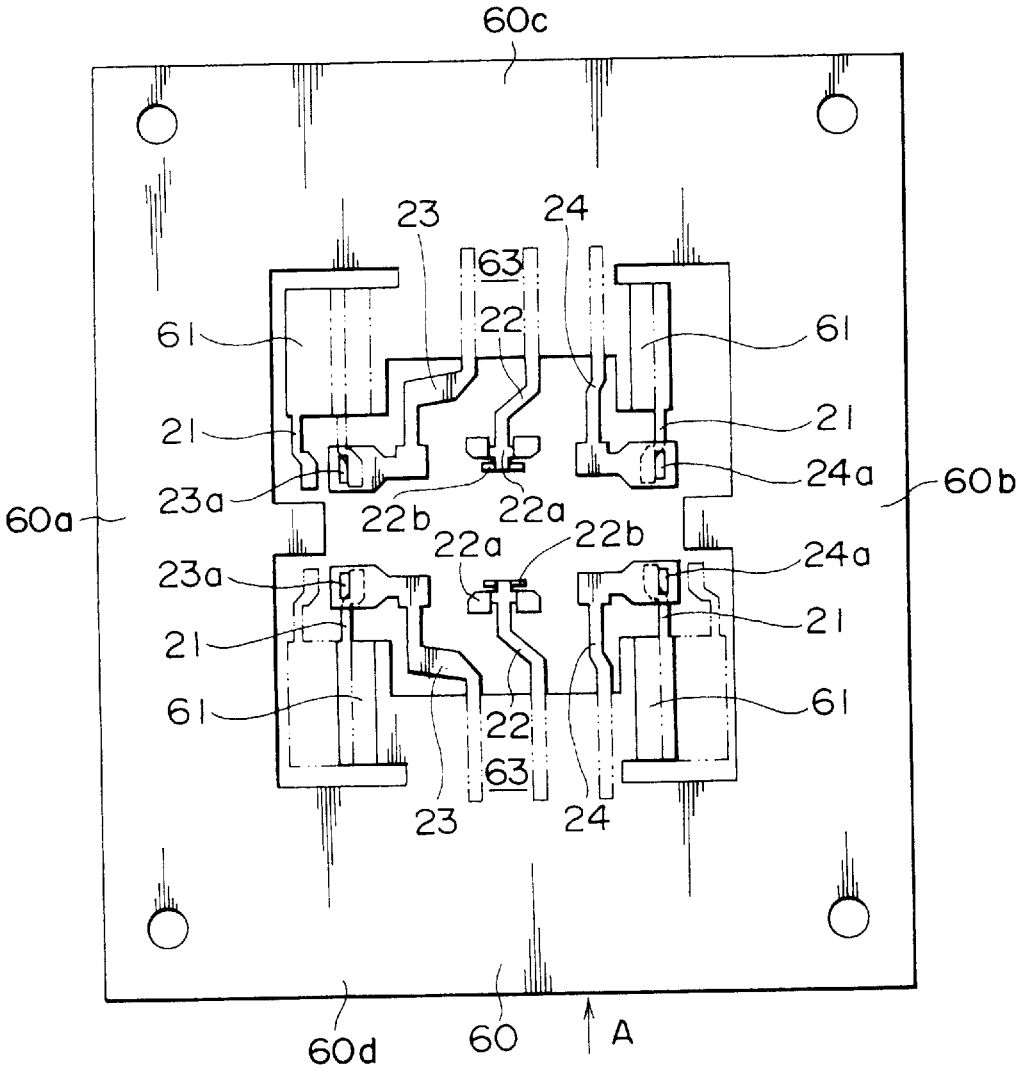
FIG. 26 is a plan view of a lead frame according to another embodiment of an electromagnetic relay according to the present invention.
Figure 27:
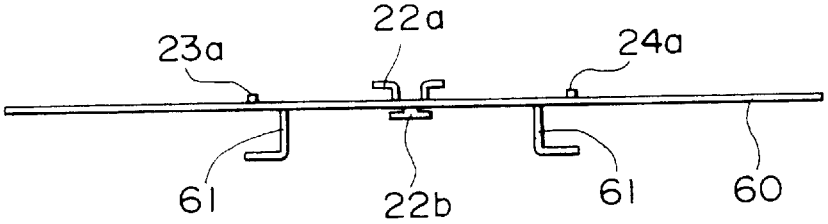
FIG. 27 is a front view of the lead frame shown in FIG. 26 in the direction of arrow A in FIG. 26.
Figure 28:
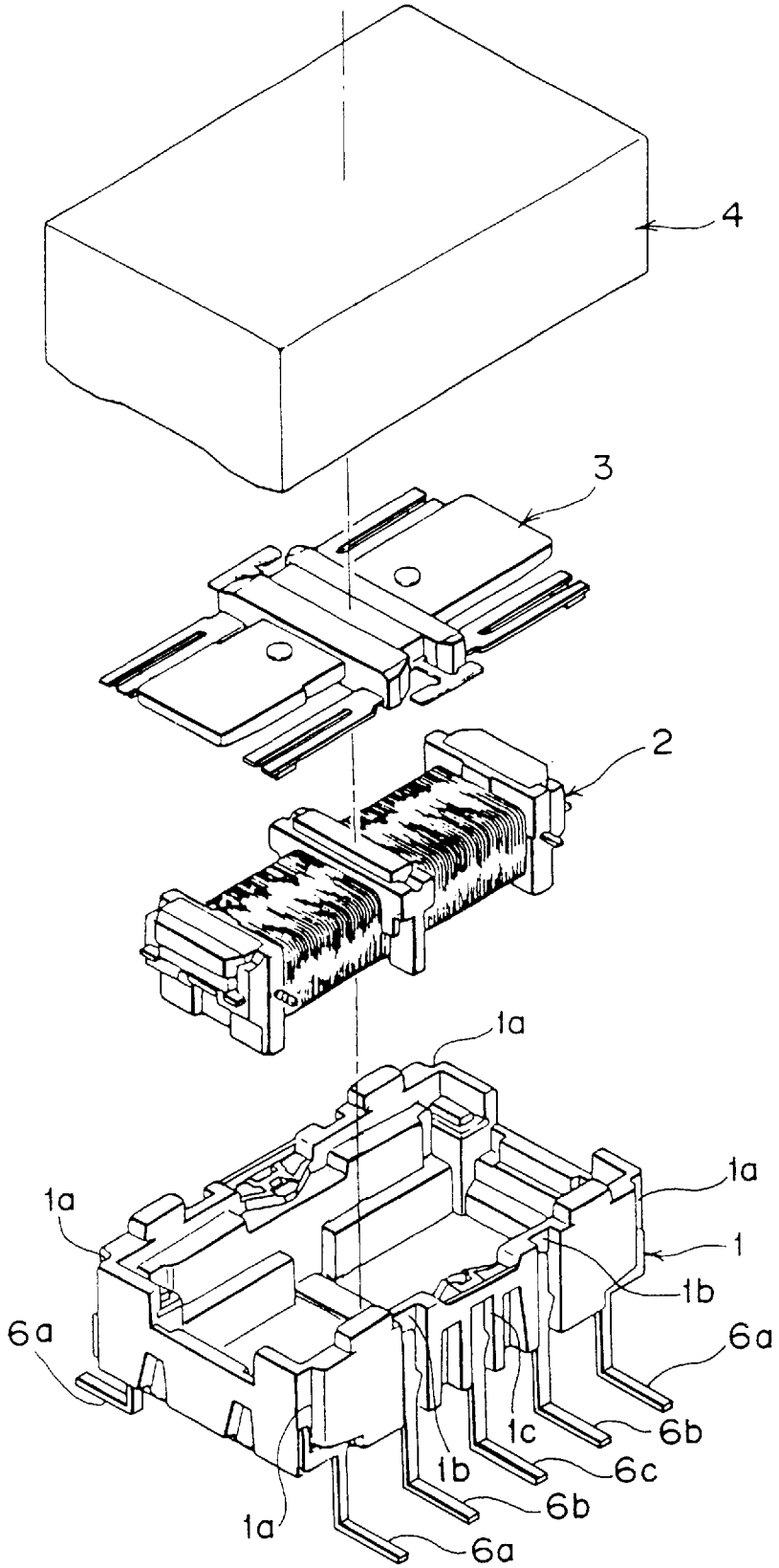
FIG. 28 is an exploded bird's-eye view of an electromagnetic relay according to the prior art.
Figure 29:
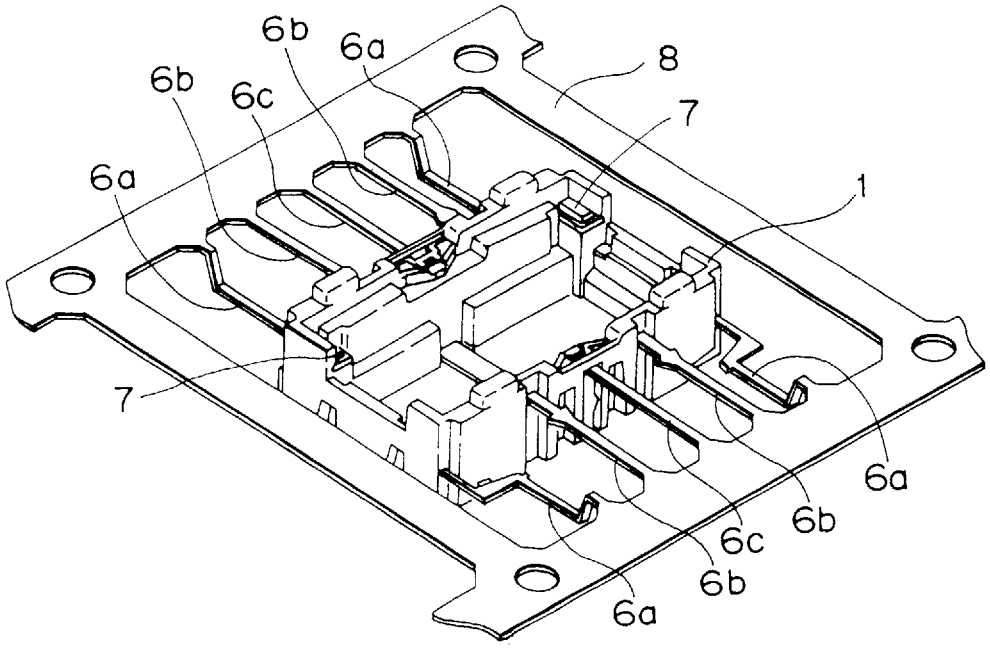
FIG. 29 is an overview used to describe the manufacturing method of the electromagnetic relay shown in FIG. 28.
Figure 30:
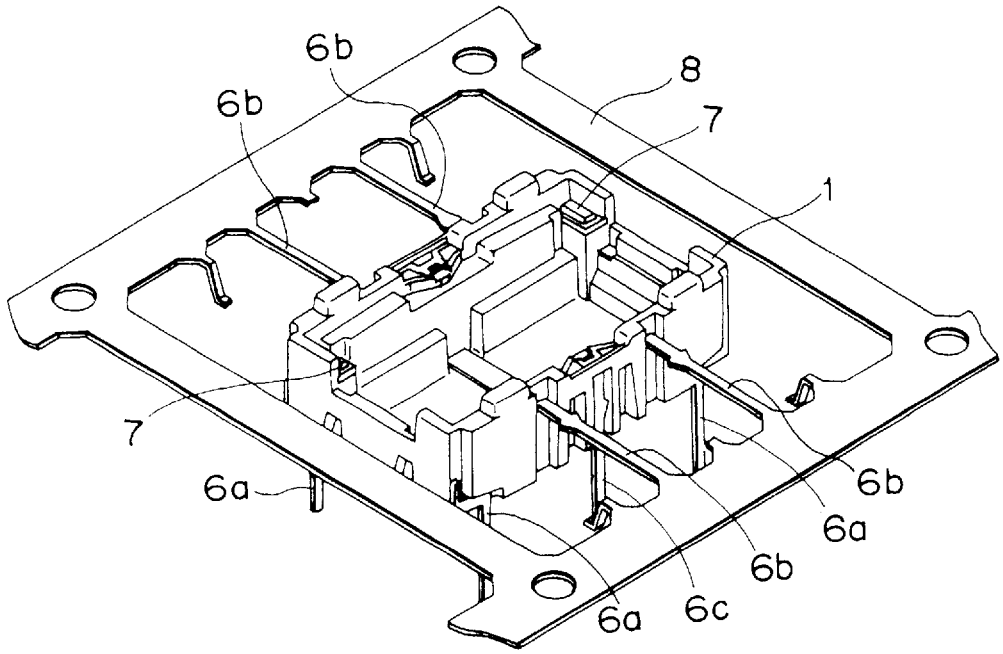
FIG. 30 is an overview used to describe the manufacturing method of the electromagnetic relay shown in FIG. 28.
Figure 31:
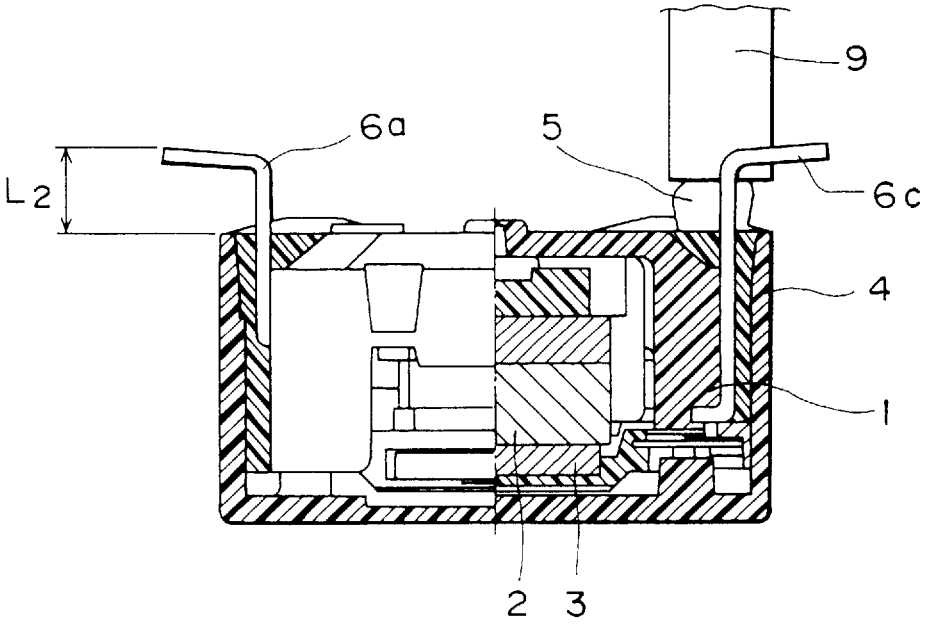
FIG. 31 is a cross section used to describe the sealing method of the electromagnetic relay shown in FIG. 28.

The coil terminals 21 are also described as extending from sides different from those from which the fixed contact terminals 23 and 24 extend in the above embodiment, but the invention shall not be so limited. As shown in FIG. 26 and FIG. 27, for example, the coil terminals 21 may be extended from the connecting members 63 of the fixed contact terminals 23 and 24 to the outside in an "L" shape through the connecting members 61, and the connecting members 61 then bend in the thickness direction to provide a step between the fixed contact terminals 23 and 24 and the coil terminals 21.

Figure 25:
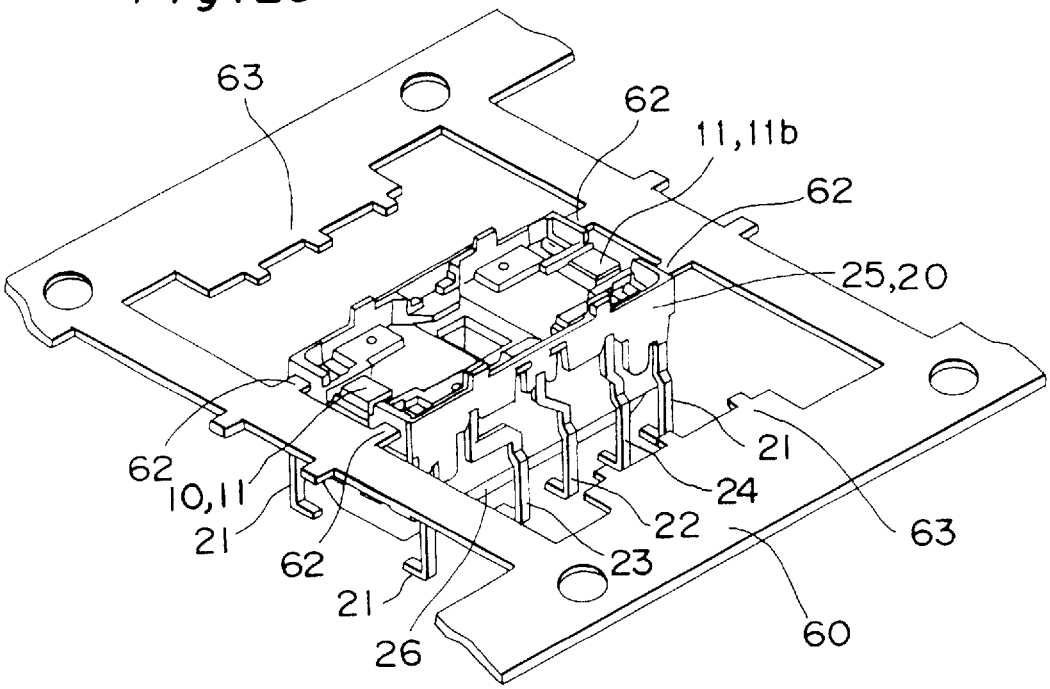
FIG. 25 is a bird's-eye view of the base block formed by a postforming method according to the present invention after press-processing the base block.

As shown in FIG. 25, a press process is next applied to the lead frame 60, now integrally connected with the base block 20 by the preceding postforming process, severing the coil terminals 21 from the connecting members 61, severing the common terminals 22 and fixed contact terminals 23 and 24 from the connecting members 63, bending the free ends of the terminals down, and then bending the terminals down from the bases thereof to complete the base block 20.

By means of this embodiment, because the connector tabs 62 of the lead frame 60 are embedded in the outside surface of the base block 20 by insertion molding, the base block 20 does not fall away from the lead frame 60 when the terminals 22, 23, and 24 are severed from the lead frame 60, and the base block 20 can therefore be transported while integrally supported by the lead frame 60.

Furthermore, because the anchoring tabs 22*b* (see FIGS. 16–18) extending axially from the T-shaped connector receivers 22*a* of the common terminals 22 are insertion molded to the open edge of the base block 20, the connector receivers 22*a* of the common terminals 22 will not come loose even after the common terminals 22 projecting from the outside surface of the base block 20 are bent from the terminal base.

The above embodiment is also described with the ends of the terminals 21, 22, 23, and 24 pre-bent to the inside, but the invention shall not be so limited. It is also possible, for example, to pre-bend the ends of the terminals 21, 22, 23, and 24 to the outside, or to first fit the case 50 to the base block 20, seal the case and base block with the sealing agent 80, tack the terminals, and then bend the terminals to the inside or outside.

It is to be noted that the advantage of bending the ends of the terminals to the inside is a smaller device footprint and resulting higher mounting density. The advantage of bending the ends of the terminals to the outside is easier soldering and improved adhesion reliability.

The permanent magnet 30 is basically a rectangular-prism-shaped sintered body of rare earth materials, and is inserted from above to the insertion hole 15*a* of the electromagnet block 10 supported by the lead frame 60 until the pole face 31 on the bottom of the permanent magnet 30 contacts the top of the core 11. The permanent magnet 30 is then polarized.

As shown in FIG. 1, the armature block 40 comprises movable contactors 42 provided on both sides of the armature 41 and molded together by the support member 43.

Figure 3:
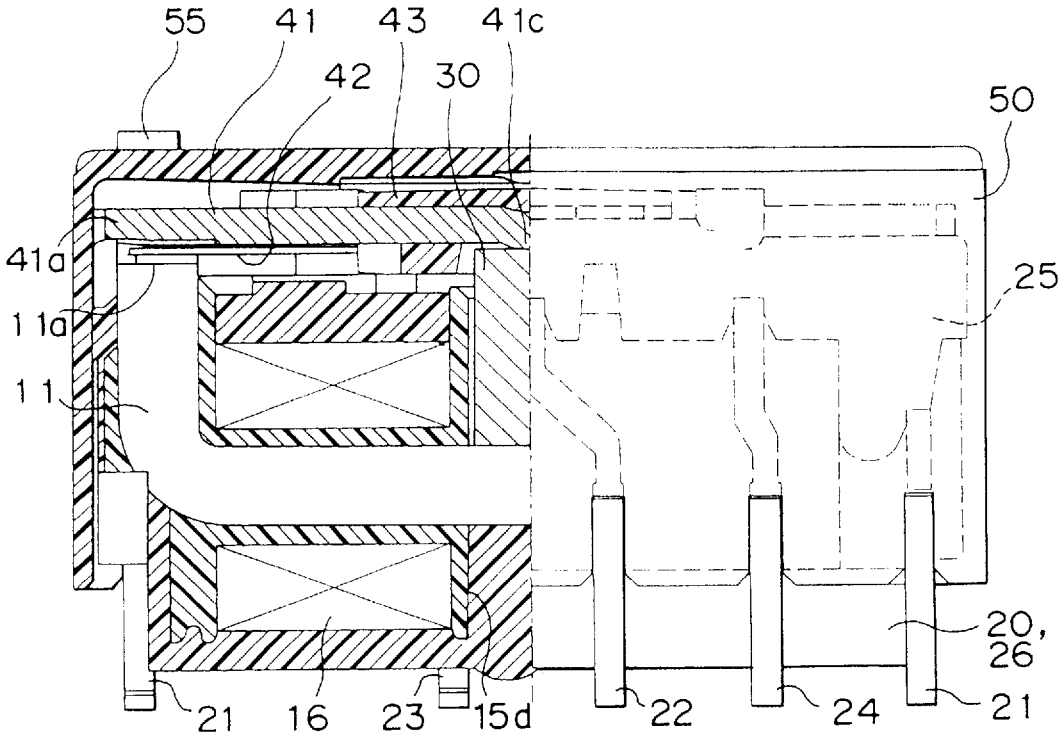
FIG. 3 is a partial cross section of a front view of the electromagnetic relay shown in FIG. 1.

The armature 41 is a flat, rectangular member made from a magnetic material with support pads 41*c* formed by extrusion at the middle of the bottom surface (see FIG. 3).

The movable contactors 42 each comprise twin contacts on each end by dividing the width of the movable contactors 42 into two parts to form movable contacts 42*a* and 42*b*. Flat T-shaped connectors 42*c* also extend to the sides from the middle of the movable contactors 42, and project from the side of the support member 43.

The support member 43 is a resin molding integrating the armature 41 and movable contactors 42 by insertion molding. The support pads 41*c* for the armature 41 are exposed from the middle bottom of the support member 43.

Therefore, the armature block 40 is assembled from above to the base block 20 supported by the lead frame 60; the support pads 41*c* of the armature 41 are placed on the pole face 32 of the permanent magnet 30; and the connectors 42*c* are positioned to the connector receiver 22*a* of the common terminals 22 and laser welded. As a result, the ends 41*a* and 41*b* of the armature 41 alternately contact and separate from the pole faces 11*a* and 11*b* of the core 11, and the movable contacts 42*a* and 42*b* alternately contact and separate from the fixed contacts 23*a* and 24*a*.

It is to be noted that because the support pads 41*c* of the armature 41 are positioned offset from the center of the pole face 32 of the permanent magnet 30, the magnetic balance between the right and left ends is disrupted, creating an automatic reset type electromagnetic relay.

The case 50 is a box-shaped resin molding for fitting to the armature block—base block subassembly. Notches 51, 51, 52, 53, and 54 are provided in the open edge of the case 50 for fitting to the coil terminals 21 and 21, common terminals 22, and fixed contact terminals 23 and 24, respectively. A gas bleeder hole 55 is provided in a top corner of the case 50.

When the case 50 is partially fit to the base block 20 supported by the lead frame 60 and then pressed down, the base block 20 is separated from the connector tabs 62 of the lead frame 60. When the case 50 is pressed further down, the case 50 is fit completely to the base block 20, and the notches 51–54 in the case 50 are fit over the middle of the terminals 21–24 with the outside surface of the middle of the terminals 21–24 flush with the outside surface of the case 50.

Figure 4:
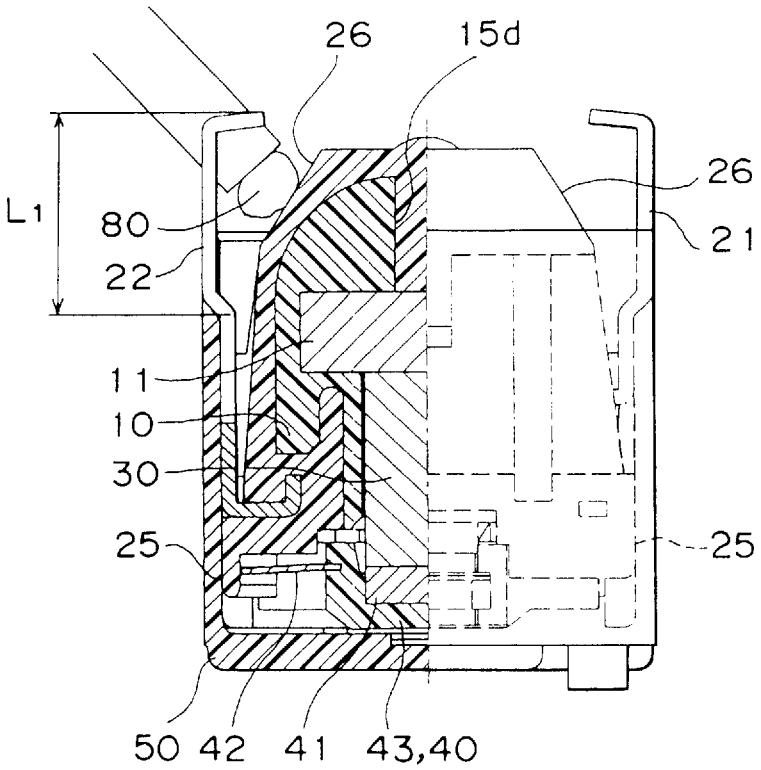
FIG. 4 is a partial cross section of a left side view of the electromagnetic relay shown in FIG. 1 used to describe the sealing process of the electromagnetic relay.

Because the height of the case 50 is less than the height of the base block 20, the bottom of the base block 20 is exposed from the open side of the case 50 as shown in FIG. 4, and the inclined face 26 provided in the outside edge members near the bottom of the base block 20 is exposed.

As a result of the present embodiment not cutting the connector tabs 62, the present embodiment provides the further benefit of no chips or other cutting residue being introduced to the base block 20.

It is to be noted that the above embodiment is described as separating the base block 20 from the connector tabs 62 by forcing the base block 20 to drop away from the connector tabs 62, but the invention shall not be so limited. It is also possible, for example, to embed the connector tabs 62 deep in the base block 20 by insertion molding, and then cut the connector tabs 62 to separate the base block 20 from the lead frame 60.

When the sealing agent 80 is then injected in the direction of the inclined face 26 provided in the outside edge members near the bottom of the base block 20, the sealing agent 80 follows this inclined face 26 to seal the gap between the base block 20 and the case 50. The continuous fitting surface 25 provided on the outside surface of the base block 20, however, contacts the inside corner edges of the case 50, thereby preventing penetration of the sealing agent 80 into the base block 20.

Assembly is completed by removing any internal gas from the gas bleeder hole 55 in the case 50, and then heat sealing the hole 55.

The operation of an electromagnetic relay comprised as described above is described below with reference to FIGS. 1–3.

First, the side-side magnetic balance of the relay is unbalanced when the relay is unexcited, causing the one end 41*a* of the armature 41 to be attracted to the corresponding pole face 11*a* of the core 11, the one movable contact 42*a* of the movable contactors 42 to contact the corresponding fixed contacts 23*a*, and the other movable contact 42*b* to separate from the corresponding fixed contact 24*a*.

When a voltage is then applied to the coil 16, creating a magnetic flux cancelling the magnetic force of the permanent magnet 30 and exciting the electromagnet block 10, the armature 41 is rocked on the support pads 41*c* against the magnetic force of the permanent magnet 30, and the one end 41*a* of the armature 41 separates from the corresponding pole face 11*a* of the core 11. The movable contacts 42*a* next separate from the fixed contacts 23*a*, the other movable contacts 42*b* contact the fixed contacts 24*a*, and the other end 41*b* of the armature 41 is attracted to the pole face 11*b* of the core 11.

When the voltage supply is then interrupted to cancel excitation of the coil 16, the magnetic imbalance is restored. The magnetic force of the permanent magnet 30 thus reverses the above operation of the armature 41, and the armature block 40 rocks back to the original unexcited state.

It is to be noted that the above embodiment is described using an electromagnetic relay formed by postprocessing the electromagnet block, but the invention shall not be so limited. It will be obvious that the invention can also be applied to electromagnetic relays made by first monolithically molding the base block to the lead frame, and then installing the electromagnet block and other internal component parts.

FIELD OF APPLICATION IN INDUSTRY

It will further be obvious that the manufacturing method for an electromagnetic relay according to the present invention can be applied to other devices. For example, the postforming of the spool may be adapted to switches and other electrical switching devices, and to postforming of other electromagnetic apparatus.

We claim:

1. An electromagnetic relay, comprising:

a case having notches;

an electromagnetic block;

a base block for housing the electromagnetic block;

an armature block assembled above the base block; and a plurality of terminals projecting from the perimeter of the base block, wherein the plurality of terminals are bent downwardly from the perimeter of the base block, and wherein middle parts of the plurality of terminals are bent outwardly to fit into the notches of the case, and forming a gap between inside surfaces of the middle parts of the plurality of terminals and outside surface of the base block.

2. The electromagnetic relay of claim 1, further comprising a sealing agent for sealing the gap between the inside surfaces of the middle parts of the plurality of terminals and the outside surface of the base block.

3. The electromagnetic relay of claim 1, wherein the outside surface of the case and the middle parts of the plurality of terminals is flush when the middle parts of the plurality of terminals are fitted into the notches of the case.

4. An electromagnetic relay, comprising:

an electromagnetic block;

a base block for housing the electromagnetic block;

an armature block assembled above the base block; and a plurality of terminals molded to the base block, wherein the plurality of terminals include fixed contact terminals and coil terminals which are integrally formed to a roughly rectangular lead frame by stamping a single conductive sheet material, wherein the fixed contact terminals are formed in roughly an inverted "L" shape from one side of the lead frame toward roughly the center area of the adjoining edge, wherein the coil terminals having free ends are formed in a U-shape through a connecting member from the center of said adjoining edge, and wherein said connecting member is bent in a direction vertical to the plane of the lead frame such that the free ends of the coil terminals are positioned just under the fixed contact terminals, providing a step between the coil terminals and the fixed contact terminals.

5. An electromagnetic relay, comprising:

an electromagnetic block;

a base block for housing the electromagnetic block;

an armature block assembled above the base block; and a plurality of terminals molded to the base block, wherein the plurality of terminals include fixed contact terminals and coil terminals which are integrally formed to a roughly rectangular lead frame by stamping a single conductive sheet material, wherein the fixed contact terminals are formed in an inverted "L" shape from one side of the lead frame toward roughly the center area of the adjoining edge, wherein the coil terminals having free ends are formed in a mirrored L-shape through a connecting member of the fixed contact terminals, and wherein said connecting member is bent in a direction vertical to the plane of the lead frame such that the free ends of the coil terminals are positioned just under the fixed contact terminals, providing a step between the coil terminals and the fixed contact terminals.

* * * * *

UNITED STATES PATENT AND TRADEMARK OFFICE

CERTIFICATE OF CORRECTION

PATENT NO. : 5,880,653

DATED : March 9, 1999

INVENTOR(S) : Mitsuhiro KAWAI et al

It is certified that error appears in the above-identified patent and that said Letters Patent is hereby corrected as shown below:

On the title page, item

[75] Inventors: Inventors Kazuo YAMADA, Ryutaro TSUCHIYA, Senjiro ISHIBASHI and Hitoshi NAKANO should have been deleted from the application in the amendment filed on March 12, 1998. The inventors should read --Mitsuhiro KAWAI; Kiyoaki KUZUKAWA; Kiyoshi OKA; Hiroyuki MIYAURA; Yoshikaga TAGUCHI; and Masayoshi TANI--

Signed and Sealed this

Fourteenth Day of March, 2000

*Attest:*

Q. TODD DICKINSON

*Attesting Officer*

*Commissioner of Patents and Trademarks*